US008544776B2

(12) United States Patent
Pallmann

(10) Patent No.: US 8,544,776 B2
(45) Date of Patent: Oct. 1, 2013

(54) DEVICE AND METHOD FOR DISSOCIATING FEED MATERIAL OCCURRING IN MIXED FORM

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 45 days.

(21) Appl. No.: 12/325,752

(22) Filed: Dec. 1, 2008

(65) Prior Publication Data

US 2009/0140085 A1 Jun. 4, 2009

(30) Foreign Application Priority Data

Nov. 30, 2007 (DE) ..... 10 2007 058 127

(51) Int. Cl.
*B02C 18/16* (2006.01)

(52) U.S. Cl.
USPC ..... 241/73; 241/243

(58) Field of Classification Search
USPC ..... 241/73, 243, 242, 286
See application file for complete search history.

(56) References Cited

U.S. PATENT DOCUMENTS

| | | | | |
|---|---|---|---|---|
| 2,890,840 | A * | 6/1959 | Fletcher et al. | 241/73 |
| 3,897,016 | A * | 7/1975 | Shah | 241/73 |
| 4,422,581 | A * | 12/1983 | Chryst | 241/66 |
| 5,228,627 | A * | 7/1993 | Yang | 241/73 |
| 5,950,940 | A * | 9/1999 | Hoof et al. | 241/73 |
| 7,213,778 | B2 * | 5/2007 | Astafan et al. | 241/73 |
| 2006/0118671 | A1 | 6/2006 | Astafan et al. | |

* cited by examiner

*Primary Examiner* — Mark Rosenbaum
(74) *Attorney, Agent, or Firm* — Muncy, Geissler, Olds & Lowe, PLLC

(57) ABSTRACT

A device and method for dissociating feed material occurring as mixed materials is provided. The device includes a rotor/stator system arranged within a housing, a rotor of the rotor/stator system being equipped around its circumference with processing tools which are radially opposed by stator tools that are arranged stationary relative to the housing while maintaining a working gap; a first circumferential section for supply of the feed material and wherein the processing of the feed material takes place along a second circumferential section, the second circumferential section being divided in a direction of rotation of the rotor into a first subsection and at least one additional second subsection; and a stator tool followed by a processing path being provided at a start of each subsection with respect to the direction of rotation of the rotor.

25 Claims, 6 Drawing Sheets

DEVICE AND METHOD FOR DISSOCIATING FEED MATERIAL OCCURRING IN MIXED FORM

This nonprovisional application claims priority under 35 U.S.C. §119(a) to German Patent Application No. DE 10 2007 058 127.2, which was filed in Germany on Nov. 30, 2007, and which is herein incorporated by reference.

BACKGROUND OF THE INVENTION

1. Field of the Invention

The present invention relates to a device for dissociating feed material occurring as mixed materials and a corresponding method.

2. Description of the Background Art

Mechanical process engineering has as its object the treatment and processing of starting materials into a final product. In view of diminishing primary raw materials, growing environmental awareness, and increasing cost pressures, it is becoming increasingly important to separate waste materials and products, which in this way reenter the product cycle as secondary raw materials.

In the recycling of waste materials and products, operators of applicable facilities are faced with huge challenges, since these materials are very different in size, form, and composition, so that reusable starting materials can only be produced from them with a great deal of effort. This is all the more true for materials and products occurring as mixed materials whose separation is especially difficult by nature. Some examples of such materials are: reclaimed lumber containing nails, screws, or other metal parts; plastic-jacketed electric cable with a metal core; used rubber tires with steel reinforcement; technical rubber parts; and electronic scrap. The goal of recycling in this context is always to extract the individual components of the mixed material as cleanly by type as possible, in order to be able to use them as a starting material for other manufacturing processes.

To this end, multistage processes and facilities are known that the feed material passes through in succession. The individual process stages here are composed of devices connected in series whose processing tools in each case are adapted to the particular nature of the feed material—in terms of size, form, and composition—produced by the device immediately upstream in the process. As a general rule, a size reduction is brought about in each stage by cutting devices. In this context, one or more components of the mixed material are removed from the feed material in each stage until finally, in the ideal case, the components of the mixed material have been separated completely from one another.

A dissociation and separation of the mixed materials can indeed be achieved with this process. The disadvantage, however, is the necessity for each processing stage to have a separate device, so that substantial financial disadvantages in terms of acquisition, maintenance, and operation must be tolerated.

From US 2006/0118671 A1 is known a device for recycling scrap tires with a horizontal rotor that is rotatably mounted within a housing. The rotor is equipped around its circumference with fragmentation tools that work together with stationary stator tools on the housing. Adjoining the stator tools in the rotor's direction of rotation is a continuous screen surface through which is drawn off the adequately broken up and fragmented feed material.

After the feed material has been fed from above, it is initially processed by being fragmented between rotor and stator tools and then by further dissociation, between the rotor surface and screen surface, of the material components combined in the mixed material. The constant design boundary conditions in the area of the processing zone result in a consistent processing of the feed material over the entire length of the screen. This has the result that such devices are suitable only for feed material whose form and size vary within narrow limits, for which reason this device is primarily appropriate for use within one stage of the above-described overall process.

A further disadvantage of such devices is the uneven wear over the screen length. It has been demonstrated that the wear of the screen surface is greatest in the area behind the stator knife, with the consequence that screens must be replaced solely because of the severe wear in that area, while sufficient reserves are still present in the end region. To increase the service life of the screens here, it is also known to turn the screens so that the section forming the screen end in the direction of rotation then forms the screen start after rotation of the screen. In this way, one obtains screens that are severely worn out from abrasion at the screen start and end while the central region exhibits only moderate signs of wear.

SUMMARY OF THE INVENTION

It is therefore an object of the present invention to further develop known devices and processes in order to achieve improvements with respect to the greatest possible application area concerning the feed material, as well as with respect to the achievable quality of the final product, and also with respect to economical operation.

In an embodiment, the invention provides for achieving both the combination of the materials involved and their separation within a single device. This is accomplished in accordance with the invention by multistage processing of the feed material, for which purpose the processing path is divided into multiple sequential subsections. Each subsection defines a processing zone with its own specific process parameters that result in a very specific type of processing and that are matched in their sequence to both the starting material and the final or intermediate product arising during the course of that type of processing. However, the primary purpose of the type of processing is not the size reduction of the feed material, but rather the dissociation of the mixed material by shearing, tearing, striking, crushing, squeezing, rasping, rolling, kneading, flexing, compaction, and the like, or a combination of some or all of these types of processing.

According to a first implementation of the invention and as a function of the type of feed material, it is possible that the processing in the first and second subsections is essentially the same, so that the feed material is subjected to the same processing multiple times, resulting in more intensive processing, and consequently higher machine performance.

Another embodiment of the invention provides for designing the sequential subsections to differ in their construction. In this way it is possible to optimize each processing stage by matching the process parameters to the type of feed material. This is particularly useful in the case of inhomogeneous feed material such as the processing of scrap tires or electronic scrap. Thus, the feed material can initially be subjected to intensive tearing and shearing forces in the first subsection with the goal of coarse dissociation of the mixed material before it is subjected to striking, rasping, kneading and/or compacting forces in the processing path of the first subsection for finer dissociation of the mixed material. The focus of processing in the second subsection can then be directed toward fragmentation of the feed material. In this regard, it is possible for the processing path of the first subsection to exclusively break up the material through the use of impact elements, and to draw off the components of the mixed material through screen surfaces only in the second subsection. However, embodiments of the invention in which the processing path of every subsection is composed of a screen are especially preferred.

As compared to prior art methods with multiple devices for this purpose, this has the advantage to firstly lowering the costs for acquisition and maintenance. The reduction and concentration of processing within just one device produces a further advantage of small space requirements, since additional devices and transfer devices from one station to the next are not required.

Due to the intensive processing of the feed material along the second circumferential section, in which two or more processing stages are always active at the same time, an inventive device works more effectively as compared to the initially mentioned device, and thus makes more economical operation possible.

According to another embodiment of the invention, provision is made that the subsections following one another in the circumferential direction can be of substantially equal size or become larger in the rotor's direction of rotation. Such a design takes into account a processing mode in which the feed material is very intensively broken up in the first subsection, and is drawn off separately in the following subsection. In this way, the increase in volume during the course of processing provides more room for the feed material and a larger screen area for extraction.

For other applications, however, it is also possible to design the first subsection larger than the subsequent sections, resulting in longer dwell times in the first circumferential section, for example. Such an embodiment can be used for feed material involving brittle materials, for example, where the brittle material content is drawn off in the first subsection after break-up of the mixed material.

For the purpose of matching an inventive device to the type of feed material, moreover, it can prove advantageous if the working gap between stator tools and processing tools is different in the direction of rotation. In addition to the possibility of making the working gap of the first tool pair in the direction of rotation smaller than or equal to the gap of the following pair, an especially preferred embodiment of the invention has tool pairs that become smaller in the rotor's direction of rotation. As a result, a processing method is established in which the feed material is first subjected to large crushing, shearing, and/or tearing forces, while the proportion of cutting work, and thus also the degree of fragmentation of the feed material, is increased with each decrease in the width of the working gap between the stator and rotor tools.

As a non-limiting example, sizes of the working gap that are suitable in this regard are between 8 mm and 10 mm in the first tool pair in the direction of rotation, and between 0.3 mm and 2 mm in the last tool pair in the direction of rotation. In the case of such a sequence of working gap sizes, the feed material in the area of the first tool pair does not experience processing by cutting, but rather processing as described above. Processing by cutting does not take place until the region of the second tool pair, where the width of the working gap is significantly smaller.

The type and intensity of processing can also be varied by the type and geometry of the processing path of the first and second subsections, where a further breaking-up of material takes place, chiefly through striking, crushing, rolling, squeezing, rasping, kneading, compaction, flexing and/or similar actions. The closed circumferential surface of the rotor, which provides the inner radial boundary of the space for the feed material, and that of the screens, which provides an outer radial boundary, result in an annular gap between them in which the feed material is subjected to the aforementioned types of processing, while at least one component of the feed material can at the same time be separated from the processing procedure through the screen surfaces. Depending on the width of the annular gap, a radial pressure can additionally be produced, bringing about an intensification of the kneading, squeezing, flexing, rasping, and/or compaction work, and resulting in faster and more complete dissociation of the mixed material and a higher screen throughput.

In this connection, in order to affect the type of processing in a controlled way, it is also possible to design the radial distance between the rotor and processing paths of the different subsections or the processing path of one subsection to be different, rather than constant. This produces a changing sequence of compression and relaxation zones for the feed material that results in a particularly intensive breaking up of the feed material. The feed material is also held for a relatively long period of time in areas with larger distance in this section. The minimum distance between the processing path and rotor can be 30 mm in this context.

Furthermore, in an embodiment, the free screen surface in the first subsection can be smaller than the free screen surface in the second subsection. In this way, the feed material can be held in the first subsection until a component of the feed material is removed through the screen surface there, while the second component can then be drawn off in the second subsection. In the case of mixed materials with one harder component, such as steel for example, the harder component can be held in the first subsection through a suitable choice of screen. There, these components act like additional processing tools on account of forced friction between them, thus additionally supporting the process of dissociating the mixed material. The effect that arises is a higher degree of separation with less wear.

In addition, the invention also includes embodiments in which the free screen area in the first subsection is larger than in the subsequent subsections in order to carry out the type of processing according to the properties of the feed material or the requirements on the final product.

A processing of the feed material matched in a targeted manner to the type of feed material is also possible through appropriate selection of the screen shapes. For example, screenings and the dwell time of the feed material in each subsection can be influenced by the shape and size of the screen aperture. The use of so-called aggressive screens with sharp edges supports the fragmentation of the feed material, while blunt screen openings increase the dwell time of the feed material in the relevant subsection of the processing path, exercising primarily a screening function and less of a fragmenting function. The screens are advantageously designed to be symmetrical in order to counteract one-sided wear by means of rotation by 180°.

Another embodiment of the invention provides stator tools both at the start of the second circumferential section and at its end. In this way, it is possible to select operation with rotation of the rotor in either one direction or the other. Firstly, this has the advantage that parts prone to wear are used from both sides, in other words symmetrically, and thus have longer service lives. Furthermore, with an asymmetrical design of the device, changing the direction of rotation also reverses the sequence of the processing zones resulting in another type of processing, and thus having an altered effect on the breakup of the feed material, without rebuilding the device. In addition, it has been demonstrated that the stator tools at the end of the processing path can effect an additional post-processing of the feed material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
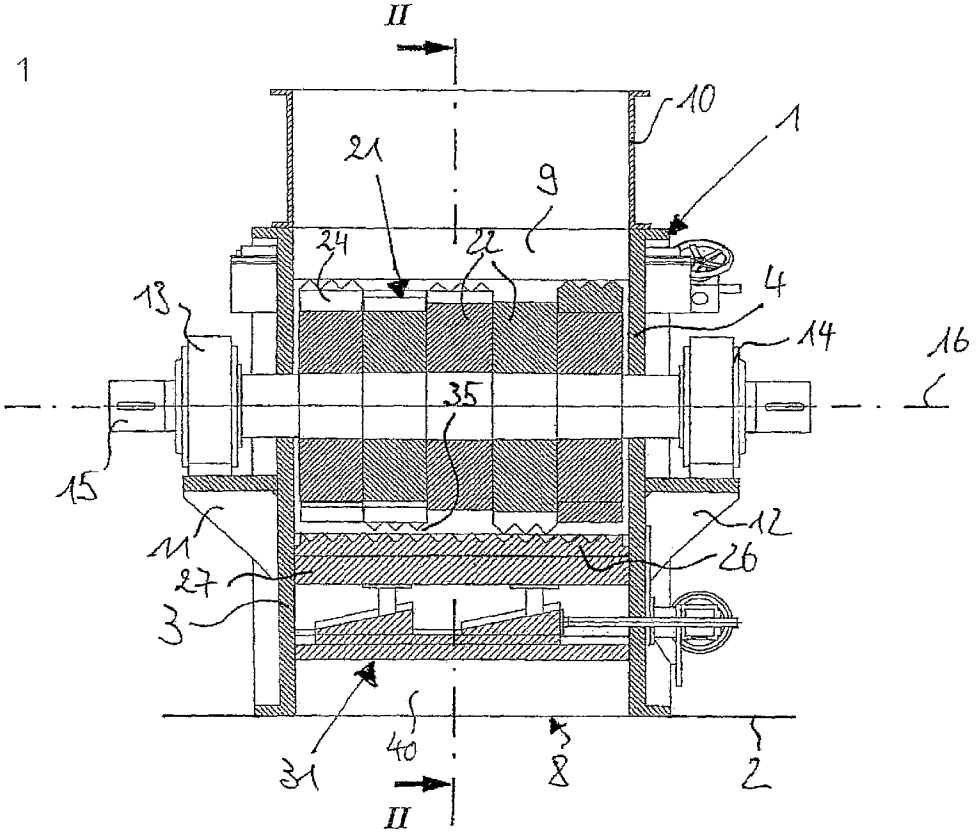
FIG. 1 is a longitudinal section through an inventive device along the line I-I shown in FIG. 2.
Figure 2:
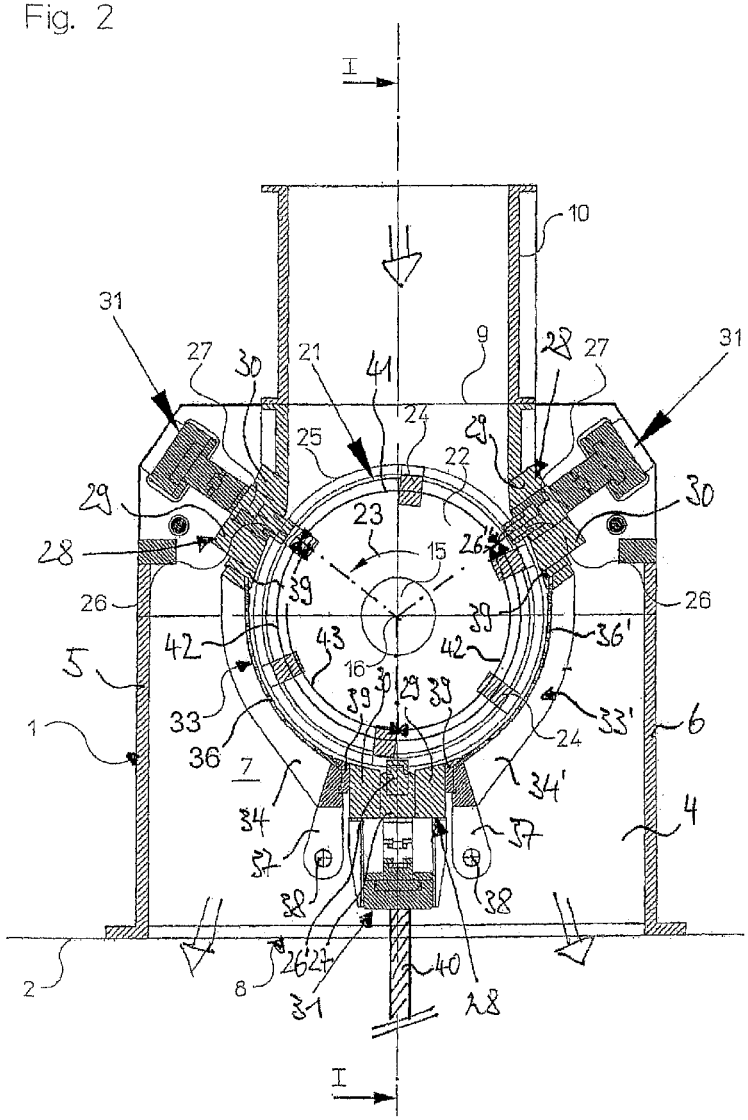
FIG. 2 is a cross-section through the device shown in FIG. 1 along the line II-II shown therein.
Figure 3:
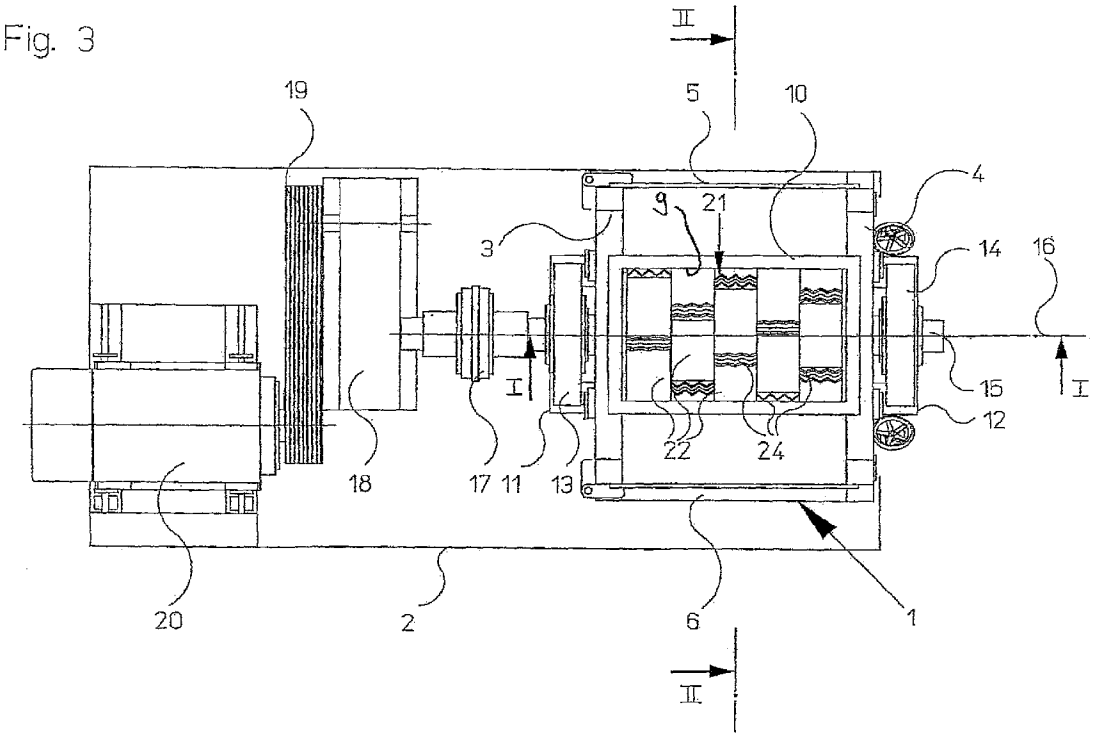
FIG. 3 is a top view of the device shown in FIGS. 1 and 2.

The general structure of an inventive device is evident from FIGS. 1 through 3. The invention comprises, firstly, an approximately rectangular housing 1, which rests on a base construction labeled 2. The housing 1 has two opposing, spaced-apart end walls 3 and 4, which, together with the side walls 5 and 6 connecting the end walls 3 and 4, enclose a work chamber 7. The housing 1 is open at the bottom by means of a material outlet 8 for drawing off material. At the top, the housing 1 is closed except for a central rectangular opening 9 that extends over the entire length of the housing 1. Placed in the opening 9 is a vertical material feed shaft 10 that extends to a rotor 21 described below.

Welded to the outer side of each of the end walls 3 and 4 in the center is a bracket 11 and 12 that serves to accommodate horizontally aligned axle bearings 13 and 14. Rotatably mounted in the bearings 13 and 14 is a horizontal drive shaft 15, which extends through openings in the end walls 3 and 4 across the entire length of the housing 1 and beyond, and whose longitudinal axis defines the axis of rotation 16. One end of the drive shaft 15 is connected to a drive 20 in the form of an electric motor through a clutch 17, a transmission 18, and a V-belt 19.

To form a rotor 21, five rotor disks 22 are mounted coaxially and in a rotationally fixed manner on the drive shaft 15 within the housing 1, with their end faces in contact with one another. Each of the rotor disks 22 has processing tools 24 distributed uniformly over its circumference. The circumferential areas between the processing tools 24 have a closed, approximately cylindrical surface. The processing tools 24 of the rotors 21 of adjacent rotor disks 22 are arranged with an angular offset about the axis of rotation 16 and describe a uniform circumferential circle 25 during rotation (FIG. 2). The direction of rotation is indicated by the arrow 23. In the present example, the processing tools 24 comprise shearing knives that have a zig-zag or undulating shape on their active edges and mesh with stator tools 26 of corresponding design while maintaining a working gap 35.

In the peripheral region of the rotor 21, a first circumferential section 41, located in the upper peak region, serves the purpose of material feed through the feed shaft 10. The breakup and separation of the feed material takes place along the remaining second circumferential section 42. The second circumferential section 42 here is divided into a first subsection 43 and a second subsection 44 with respect to the direction of rotation 23 (FIG. 2).

The first subsection 43 comprises, starting in the rotor's direction of rotation 23, stator tools 26 located directly adjacent to the feed shaft 10, which extend over the full length of the rotor 21 in the axial direction and lie radially opposite to the processing tools 24 while maintaining a working gap 35. Because of the width of the tools 24 and 26 extending in the direction of rotation, the working gap 35 has a three-dimensional form that facilitates processing of the feed material. As already described, the stator tools 26 have a profile that is complementary to the processing tools 24 of the rotor 21, and work together therewith to process the feed material.

As is evident primarily from FIGS. 1 and 2, the stator tools 26 are removably held in holders 27 over their entire length. In this regard, the holders 27 can be radially displaced by means of adjusters 31 so as to be able to set the width of the working gap 35 to the desired measurement. Moreover, a clamping device 28, having clamping bars 29 and 30, serves to fix the holders 27 and thus the stator tools 26 in place during processing operation.

The construction of the holders 27, the adjuster 31 and the clamping device 28, and their detailed function, are described in detail in German patent application 10 2006 056 542.8, the content of which shall be considered to be disclosed herewith by reference.

The first subsection 43, which defines the first processing stage, also includes a screen 33, comprising essentially a screen support 34 in the form of a frame or grid and screen elements 36 clamped thereto by means of clamping elements 39, which follows the stator tools 26 in the direction of rotation 23 and extends approximately to the lower apex of the rotor 21. In the base region 37 of the screen support 34, the screen 33 is supported such that it can pivot about an axle 38 so as to be better able to carry out maintenance and repair work by opening the screen 33.

The second subsection 44, which adjoins the first subsection 43 in the direction of rotation 23, has a comparable structure with the stator tools 26' and the screen 33'; for this reason, reference is made to the content of the description above to avoid repetition.

Lastly, the end of the second circumferential section 42 is formed by the stator tools 26", which also correspond to the stator tools 26 in structure and support.

As is evident primarily from FIG. 1, the stator tools 26, 26', and 26" have a zig-zag or undulating profile that works together with the processing tools 24 of complementary design in the course of the rotation of the rotor 21. Other designs of the stator tools and processing tools are also possible, for example straight edges. With the aid of the adjuster 31 associated with each stator tool 26, 26', 26", the working gap 35 of each tool pair can be set individually, wherein larger working gaps 35 result in processing of the feed material primarily through tearing and/or shearing, while adequately small working gaps 35' primarily result in processing by cutting. Thus a gradual transition from processing by tearing and/or shearing to processing by cutting can be achieved by appropriate graduation of the working gap.

Figure 4:
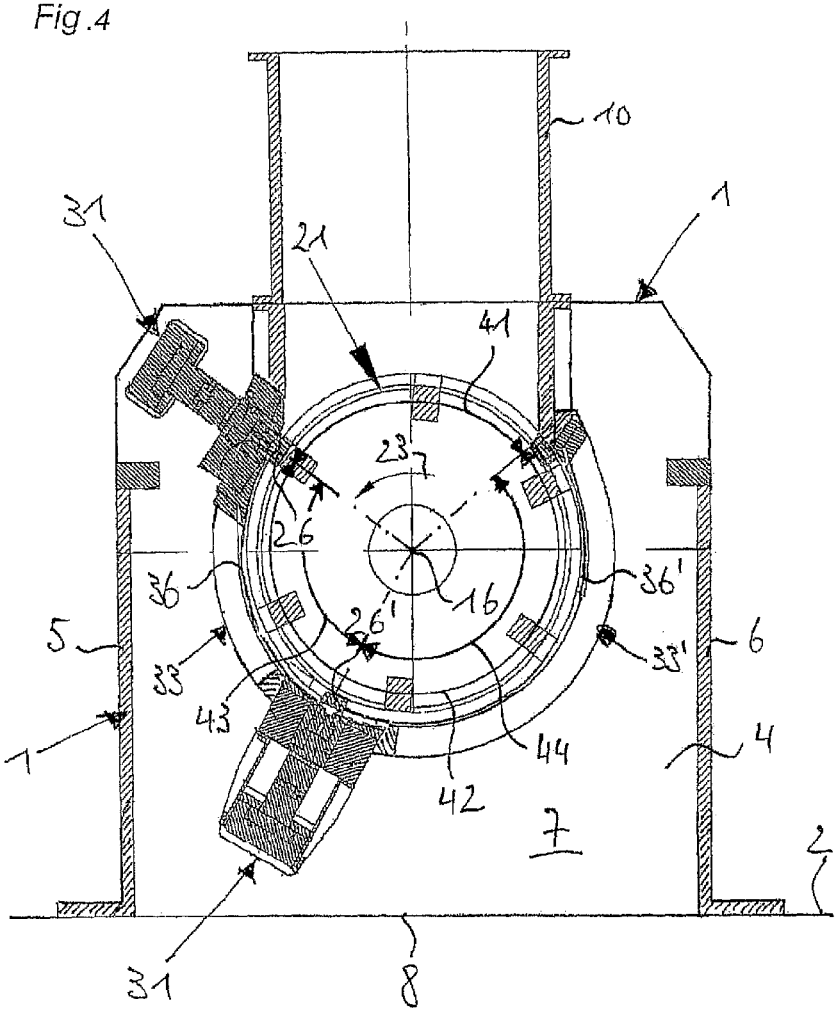
FIG. 4 is a cross-section through another embodiment of the invention.

In essence, the embodiment of the invention shown in FIG. 4 differs from those described above only in the way the second circumferential section 42 is divided into the subsections 43 and 44 and in the elimination of third stator tools 26". As a result of an arrangement of the second stator tool 26' that is displaced opposite the direction of rotation 23 from the lower apex, there is a division of the second circumferential section 42 in favor of the second subsection 44; in other words, the second subsection 44 has a greater length in the direction of rotation 23 and thus a larger screen area. As a result of the longer dwell time of the feed material in the second subsection 44, a more intensive processing of the feed material can be achieved there.

Figure 5A:
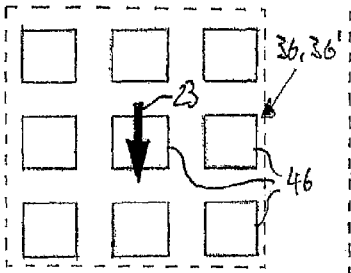
FIGS. 5*a* through 5*g* and 6*a* through 6*e* show different views of the screen paths of the first or second circumferential sections of an inventive device.
Figure 5B:
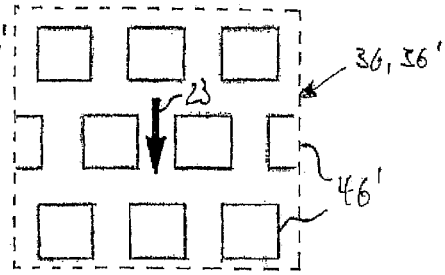
Figure 5C:
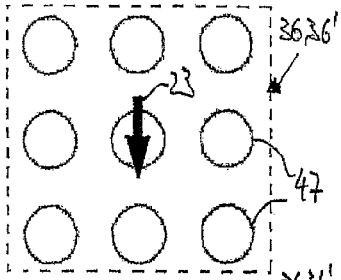
Figure 5D:
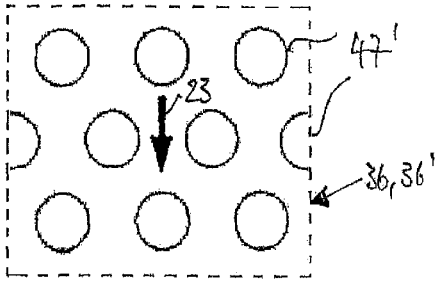
Figure 5E:
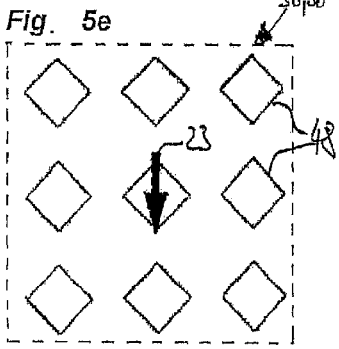
Figure 5F:
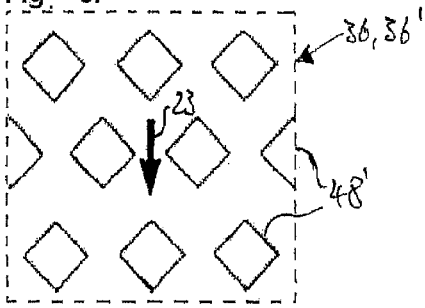
Figure 5G:
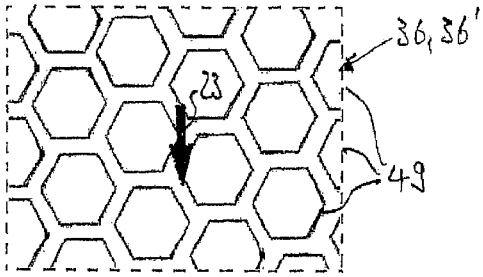

FIGS. 5*a* through 5*g* and 6*a* through 6*e* show possible embodiments of the screen elements 36 and 36' of the screens 33, 33', which can be selected and combined with one another in the subsections 43 and 44 as a function of the type of feed material and the desired processing type as well as the type and properties of the end product to be produced. FIG. 5*a* shows a screen element 36, 36' with square screen openings 46, which are aligned in the direction of rotation 23. FIG. 5*c* shows screen elements 36, 36' with circular screen openings 47, and FIG. 5*e* shows screen elements 36, 36' with lozenge-shaped screen openings 48, each likewise in an aligned arrangement. FIGS. 5*b*, 5*d*, and 5*f* disclose like screen openings 46', 47', and 48', but with an offset of half their spacing in a direction transverse to the direction of rotation 23. FIG. 5*g* shows screen elements 36, 36' with a honeycomb structure whose hexagonal screen openings 49 provide a relatively large open screen area.

Figure 6A:
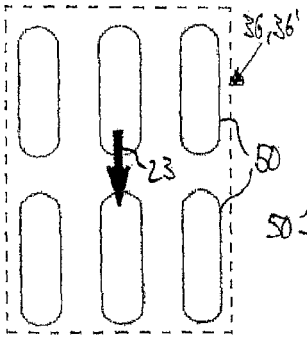
Figure 6B:
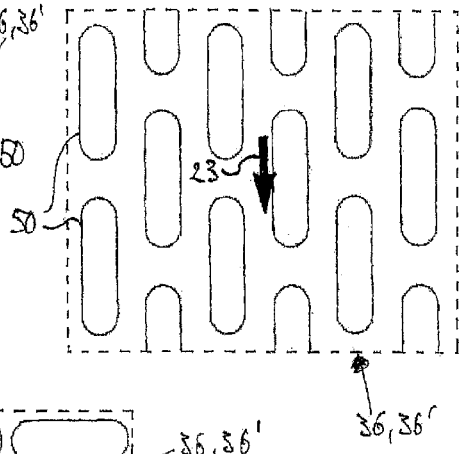
Figure 6C:
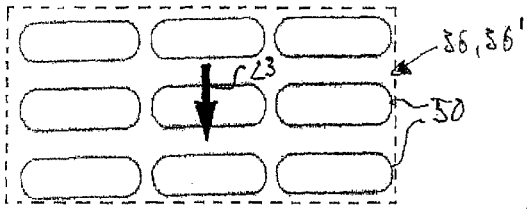
Figure 6D:
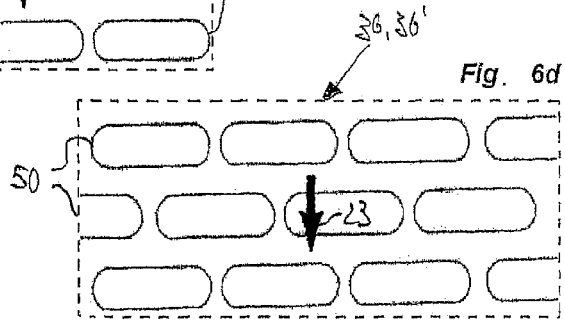
Figure 6E:
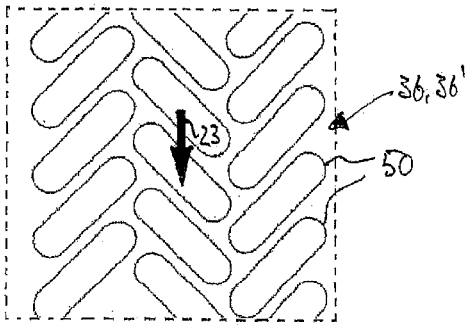

In contrast to the above-described screen elements 36, 36', the screen openings 50 shown in FIGS. 6*a* through 6*e* have a pronounced longitudinal extension, which can extend in the direction of rotation 23 (FIGS. 6*a* and 6*b*) as well as perpendicular thereto (FIGS. 6*c* and 6*d*) or diagonally thereto (FIG. 6*e*). This makes it possible to adapt to a feed material with a mixture component that also has a pronounced longitudinal extension, as for example wires, nails, cables and the like.

An inventive device can be operated in a variety of configurations by combining and varying the above-described features in order to adapt to feed materials of differing form, size and consistency and to the type of the end product.

In a first configuration of the invention, the device is operated with identical screen elements 36, 36' in all subsections 43, 44 and with uniform working gaps 35 between the stator tools 26 and the processing tools 24. This results, firstly, in the advantage of increased machine performance through the provision of additional stator tools 26' and better utilization of the screens 33, 33'.

A different configuration can be chosen to match an inventive device to the unique characteristics of a particular feed material; this is described in detail below using the example of scrap tire recycling. This feed material is characterized by strongly bonded rubber and steel linings, which must be recovered with the best possible separation by type.

Suitable for this purpose is, for example, an embodiment of the invention wherein the working gap 35 between the stator tools 26 and processing tools 24 is larger than the working gap 35' between the stator tools 26' and processing tools 24, a condition that can be established quickly and easily with the aid of the adjusters 31 and the clamping devices 28. In addition, a screen 33 is chosen in the first subsection 43 that has a smaller open screen area than in the second subsection 44. As a result of the width of the working gap 35, this combination results in dissociation of the material mixture between the stator tools 26 and the rotor tools 24 at the start of processing through tearing, shearing, crushing and striking, releasing the steel linings. The portion of the rubber that has already been adequately reduced in size can be drawn off as soon as this early stage through the screen elements 36, 36'. Next, the feed material arrives in the area of the processing path of the first subsection 43, where it experiences processing by flexing, rolling, kneading and compaction in the annular gap between the screen 33 and the circumferential surface of the rotor 21. The breakup of the feed material thus achieved is additionally assisted by the rotating rotor tools 24, which also act on the feed material in the area of the screen 33.

The type of processing that takes place in the annular gap of the first subsection 43 between the screen 33 and the rotor 21 also has the result that steel wires present there rub against one another due to the forced flexing, kneading and rolling motion and thus free one another from adhering rubber parts, considerably accelerating the breakup of the mixed material.

In order to adjust the inventive device to the properties of the already partially processed feed material, the working gap 35' between the stator tools 26' and the rotor tools 24 can be chosen smaller. This intensifies the fragmentation work taking place there. If it should be necessary, the working gap 35' can be set to less than 0.5 mm, for example 0.3 mm, resulting in fragmentation of the feed material by cutting. With a working gap 35' that is larger than this, for example between 1 mm and 3 mm, the proportion of cutting work drops and the proportion of shearing and tearing increases.

In the area of the processing path of the second subsection 44, the steel component can be removed from the feed material through the use of screen elements 36' with elongated screen openings 50. At the same time, the rubber component that is sufficiently reduced in size can be drawn off through the screen 33'. A dividing wall 40, indicated schematically in FIGS. 1 and 2, which separates the first subsection 43 from the second subsection 44 in the area of the material outlet 8, ensures that the components thus extracted in the individual subsections 43, 44 are not mixed together.

Also suitable for separating the components of scrap tires are embodiments of the invention wherein the device has a structure that is symmetrical in cross-section, which is to say that the first subsection 43 and the second subsection 44 are alike, and thus two like process sequences take place, one immediately after the other. Here, working gaps 35, 35' are preferred that essentially produce a coarse breakup of the feed material by shearing and/or tearing, said breakup being completed by subsequent processing in the area of the processing paths.

It is a matter of course that the invention is not limited to the combinations of features described in the above example embodiments. Rather, the invention also encompasses combinations of features from different example embodiments or new combinations within individual example embodiments. Thus, any desired screen shapes can be combined with one another in the individual subsections. Similarly, it is possible to vary the working gaps in the individual tool pairs or the lengths of the individual subsections as desired without departing from the scope of the invention. Embodiments with three or more subsections in the area of the processing path are also possible within the scope of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for dissociating feed material occurring as mixed materials, the device comprising:

a rotor/stator system arranged within a housing, a rotor of the rotor/stator system being equipped around its circumference with processing tools which are radially opposed by stator tools that are arranged stationary relative to the housing while maintaining a working gap;

a first circumferential section for supply of the feed material and wherein the processing of the feed material takes place along a second circumferential section, the second circumferential section being divided in a direction of rotation of the rotor into a first subsection and at least one additional second subsection, the first subsection and the at least one additional second subsection each forming a processing zone; and a stator tool followed by a processing path being provided at a start of each processing zone with respect to the direction of rotation of the rotor, wherein each processing zone has its own specific process parameters for a given type of processing, at least two of the processing zones having different process parameters for different types of processing, wherein the device has an operating configuration wherein working gaps, between two successive pairs of tools in the direction of rotation having the stator tool and the processing tool, are different sizes, and wherein at least two of the processing zones have different types of stator tools for different types of processing.

2. The device according to claim 1, wherein the subsections are substantially the same size.

3. The device according to claim 1, wherein the subsections have different sizes.

4. The device according to claim 3, wherein the subsections become larger in the direction of rotation.

5. The device according to claim 1, wherein the working gap between two successive pairs of tools in the direction of rotation becomes smaller.

6. The device according to claim 1, wherein a working gap between the first pair of tools in the direction of rotation is ≤10 mm or ≤8 mm.

7. The device according to claim 1, wherein a working gap between the last pair of tools in the direction of rotation is ≥0.3 mm.

8. The device according to claim 1, wherein a radial distance between the rotor circumference and processing path in the circumferential direction is different at the ends of the processing path than in the center region.

9. The device according to claim 1, wherein the processing path of the first subsection is composed of an impact element, and the processing path of the second subsection is composed of a screen.

10. The device according to claim 9, wherein the screen openings, in at least one subsection or in a second subsection, have a pronounced direction of longitudinal extension.

11. The device according to claim 10, wherein the screen openings are oriented parallel, perpendicular or diagonal to the direction of rotation.

12. The device according to claim 9, wherein the screen openings in at least one subsection are circular, rectangular, square, or honeycomb-shaped.

13. The device according to claim 12, wherein the screen openings are square and one diagonal of the screen openings extends parallel to the direction of rotation.

14. The device according to claim 12, wherein the screen openings of a row are arranged with a lateral offset relative to the screen openings of an adjacent row in the direction of rotation.

15. The device according to claim 9, wherein the screen elements are substantially symmetrical about a screen center line.

16. The device according to claim 1, wherein the processing paths of the first subsection and second subsection are each formed a screen.

17. The device according to claim 1, wherein an open screen area of screen elements in the first subsection is smaller than an open screen area of the screen elements in the next subsection in the direction of rotation.

18. The device according to claim 1, wherein the stator tools and processing tools have cooperating edges with a straight, zig-zag or undulating shape.

19. The device according to claim 1, wherein the material outlet has a dividing wall that separates the space downstream of the first subsection from the space downstream of the second subsection.

20. The device according to claim 1, wherein an additional stator tool is located at an end of the second circumferential section.

21. The device according to claim 1, wherein a working gap between the last pair of tools in the direction of rotation is ≥0.5 mm.

22. The device according to claim 1, wherein a radial distance between the rotor circumference and processing path in the circumferential direction is greater at the ends of the processing path than in the center region.

23. The device according to claim 1, wherein the different types of stator tools are selected from stator tools configured for shearing, tearing, striking, crushing, squeezing, rasping, rolling, kneading, flexing, compaction, or a combination thereof.

24. A device for dissociating feed material occurring as mixed materials, the device comprising:

a housing;

a stator in the housing comprising at least first and second circumferentially spaced stator tools arranged stationary relative to the housing;

a rotor having a circumference provided with at least first and second rotor tools, the rotor being mounting in the housing for rotation relative to the at least first and second stator tools; and a circumferential section for supply of the feed material;

wherein the device is configured for operation with working gaps of different sizes between pairs of the at least first and second rotor tools and the at least first and second stator tools, and wherein the first stator tool is configured to perform a first type of processing and wherein the second stator tool is configured to perform a second type of processing different than the first toe of processing.

25. A device for dissociating feed material occurring as mixed materials, the device comprising:

a housing;

a stator in the housing comprising at least first and second circumferentially spaced stator tools arranged stationary relative to the housing;

a rotor having a circumference provided with at least first and second rotor tools, the rotor being mounting in the housing for rotation relative to the at least first and second stator tools; and a circumferential section for supply of the feed material;

wherein, during the dissociation of feed material with the rotor rotating relative to the stator, working gaps of different sizes exist between pairs of the at least first and second rotor tools and the at least first and second stator tools, and wherein the first stator tool is configured to perform a first type of processing and wherein the second stator tool is configured to perform a second type of processing different than the first type of processing.

* * * * *